United States Patent [19]

Day

[11] Patent Number: 4,724,006

[45] **Date of Patent: * Feb. 9, 1988**

[54] PRODUCTION OF CRYSTALLINE FRUCTOSE

[75] Inventor: Gary A. Day, Decatur, Ill.

[73] Assignee: A. E. Staley Manufacturing Company, Decatur, Ill.

[ * ] Notice: The portion of the term of this patent subsequent to Feb. 17, 2004 has been disclaimed.

[21] Appl. No.: 652,780

[22] Filed: Sep. 20, 1984

Related U.S. Application Data

[63] Continuation-in-part of Ser. No. 588,479, Mar. 9, 1984, Pat. No. 4,643,773.

[51] Int. Cl.[4] ..... C13F 1/02

[52] U.S. Cl. ..... 127/30; 127/58; 127/60

[58] Field of Search ..... 127/30, 58, 60

[56] References Cited

U.S. PATENT DOCUMENTS

| | | | |
|---|---|---|---|
| 2,943,004 | 6/1960 | Haury | 127/58 |
| 3,513,023 | 5/1970 | Kusch et al. | 127/58 |
| 3,607,392 | 9/1971 | Lauer et al. | 127/30 X |
| 3,883,365 | 5/1975 | Forsberg et al. | 127/60 |
| 3,928,062 | 12/1975 | Yamauchi | 127/60 |
| 4,199,373 | 4/1980 | Dwivedi et al. | 127/60 |
| 4,199,374 | 4/1980 | Dwivedi et al. | 127/60 |
| 4,371,402 | 2/1983 | KuSota | 127/60 |

FOREIGN PATENT DOCUMENTS

| | | | |
|---|---|---|---|
| 2015591 | 1/1972 | Fed. Rep. of Germany . | |
| 77919 | 2/1984 | Portugal . | |
| 2133796 | 8/1984 | United Kingdom | 127/30 |

*Primary Examiner*—Richard V. Fisher
*Assistant Examiner*—W. Gary Jones
*Attorney, Agent, or Firm*—Michael F. Campbell; James B. Guffey; J. Daniel Wood

[57] ABSTRACT

This invention describes the production of crystalline fructose from an aqueous dispersion utilizing an alcohol and controlled temperature conditions. The aqueous dispersion is maintained at an elevated temperature of 50° C. to 80° C. and admixed with the alcohol at a weight ratio of 3:1 to 1:3. The alcohol is selected from methanol, ethanol, isopropanol and mixtures thereof and maintained at a temperature between 46° C. and 75° C.

20 Claims, No Drawings

PRODUCTION OF CRYSTALLINE FRUCTOSE

CROSS-REFERENCE TO RELATED APPLICATION

This application is a continuation-in-part of Ser. No. 06/588,479, filed Mar. 9, 1984 now U.S. Pat. No. 4,643,773.

BACKGROUND OF THE INVENTION

1. Field of the Invention

This invention relates to obtaining high purity crystalline fructose in high yields.

2. Description of the Art Practices

Fructose is commonly used as a high fructose syrup in the soft drink and cookie mix industries because of its high sweetening power in relation to its weight. Fructose is more than twice as sweet as table sugar (sucrose) when used on an equivalent weight basis.

The fructose is typically produced by hydrolyzing corn starch to dextrose (glucose), isomerizing the dextrose substantially to fructose, and selling the resultant mixture of dextrose and fructose as a liquid syrup. Of course, the liquid syrup is not aesthetically desirable as a sucrose substitute for consumer uses. While fructose has many institutional uses as a syrup, it has not been successfully commercialized as a dry powder to consumers. As fructose is considerably sweeter than sucrose, it is desirable to obtain crystalline fructose which would aid diet-conscious persons by giving an equivalent level of sweetening at a substantially reduced caloric intake level.

As fructose is obtained as a syrup in mixtures with dextrose which is not as sweet as fructose, it is desirable that the dextrose be removed. The difference while not noticeable on a taste basis, nonetheless adds extra calories without the desired sweetening benefit.

Another factor which must be considered in the processing of fructose to give a substantially crystalline powder is the high solubility of fructose in water. As previously noted, the conversion of starch to dextrose and the dextrose to fructose syrup is accomplished in the presence of water. While the high solubility of fructose presents substantial difficulties in obtaining crystalline fructose, it is nonetheless beneficial in that an aqueous dispersion containing fructose is relatively easy to transport and pump with a substantial solids content.

U.S. Pat. No. 3,607,392 issued Sept. 21, 1971 to Lauer describes a process and apparatus for obtaining crystalline fructose through the use of methanol. Methanol has limits on its usage in food products which is the major market for crystalline fructose in the first instance. Forsberg et al in U.S. Pat. No. 3,883,365 issued May 13, 1975 describes the separation of fructose from dextrose within a narrowly constrained pH range by lowering the temperature of the reaction mixture. The disadvantage in the Forsberg et al process is that it is not economical to refrigerate a syrup. Typically, the syrups containing fructose are at a minimum of 30° C. due to the high temperature processing conditions and simply to maintain the syrup in a fluid state. The refrigeration of a syrup therefore requires a substantial degree of energy and equipment to remove the heat in the syrup.

Yamauchi U.S. Pat. No. 3,928,062 issued Dec. 23, 1975 describes recovering fructose by seeding anhydrous fructose crystals into a supersaturated solution of fructose. Kubota in U.S. Pat. No. 4,371,402 issued Feb. 1, 1983 states that the dehydration of fructose occurs utilizing an organic solvent having azeotropic behavior with respect to water.

Dwivedi et al in U.S. Pat. No. 4,199,373 issued Apr. 22, 1980 describes obtaining anhydrous free-flowing crystalline fructose by allowing a seeded syrup to stand at a low temperature and high relative humidity. U.S. Pat. No. 4,199,374 also issued on Apr. 22, 1980 to Dwivedi et al suggests seeding a syrup containing fructose and allowing it to stand followed by recovery of the fructose. U.S. Pat. No. 3,513,023 to Kusch et al issued May 19, 1970 discloses the recovery of crystalline fructose over a broad pH range through concentration and cooling, followed by seeding of the mixture.

Two substantial difficulties have been recognized in the art in the production of crystalline fructose. The first problem is to remove water from the syrup thereby placing the fructose in a condition where it may crystallize. As previously noted, the high solubility of the fructose requires that the water be substantially removed as it is not otherwise possible to obtain the crystalline fructose. The method such as that described in Kubota is too difficult to practice inasmuch as the addition of alcohol to the syrup can result in a gummy mass. The gummy nature of the syrup following alcohol addition under ordinary procedures is such that fructose cannot be crystallized. When crystallization does occur in the gummy mass, it is likely as not to foul the pumps or transfer lines within the reactors. Of course, any dextrose or other material in the syrup at that time will necessarily be trapped within the gummy mass and therefore the purity of the fructose will be substantially lessened.

The second problem in obtaining crystalline fructose is to obtain the material in a particle size distribution similar to sucrose. The particle size distribution is a function of avoiding the gummy mass as this phenomena overwhelms the controlled seeding required in obtaining the desired crystals.

It is therefore desirable that a method be devised for the production of crystalline fructose through the use of alcohols to disassociate the water in the syrup from the fructose wherein the syrup is stable and supersaturated with regard to the fructose.

Throughout the specification and claims, percentages and ratios are by weight, temperatures are in degrees Celsius, and pressures are at atmospheres over ambient unless otherwise indicated. To the extent that any of the references mentioned herein are applicable to the present invention, they are incorporated by reference.

SUMMARY OF THE INVENTION

The present invention describes a process for obtaining a homogeneous mixture from which crystalline fructose can be separated including the steps of:

(a) obtaining an aqueous dispersion containing at least about 85% by weight fructose on a dry solids basis;

(b) maintaining the aqueous dispersion at a temperature of at least about 50° C.;

(c) introducing to the aqueous dispersion an alcohol selected from the group consisting of methanol, ethanol, isopropanol and mixtures thereof, wherein the alcohol is at a temperature substantially similar to the dispersion (b) at the time of introduction of the alcohol;

thereby obtaining a substantially homogeneous mixture.

A further embodiment of the invention is a process for obtaining a homogeneous mixture from which crystalline fructose can be separated including the steps of:

(a) obtaining an aqueous dispersion containing at least about 85% by weight fructose on a dry solids basis;

(b) maintaining the aqueous dispersion at a temperature of from about 50° C. to about 80° C.;

(c) introducing to the aqueous dispersion an alcohol selected from the group consisting of methanol, ethanol, isopropanol and mixtures thereof, wherein the alcohol is at a temperature of from about 46° C. to about 75° C. at the time of the introduction of the alcohol;

thereby obtaining a substantially homogeneous mixture.

DETAILED DESCRIPTION OF THE INVENTION

The most important feature of the present invention is that when the fructose-containing syrup (aqueous dispersion) is processed according to the teachings herein the fructose should remain in a super-saturated state without forming a slimy, gummy mass upon the addition of the alcohol. The alcohol, as later described, is used to remove water from the fructose in the syrup thereby increasing the saturated state of the fructose. The slimy mixture (amorphous precipitated sugars which present distinct phases in a mixing vessel) results when a portion of the fructose begins to crystallize as the alcohol is added. The slimy mixture is not desirable in that it will plate out and foul any surface on which the fructose can further crystallize.

For economical processing, it is necessary that the fructose only crystallize when and where desired. If the fructose is allowed to crystallize at any point, including immediately after the addition of the alcohol, the end result is that the tanks must be cleaned and the process shut down until the cleaning is complete.

A desired step in the processing is the transfer of the alcohol-laden dispersion to a crystallization vessel where seeding is accomplished thereby controlling crystal size. If the fructose in the form of a slimy mass is introduced into the crystallization vessel, the crystal growth of the fructose will preferentially take place around the slimy mass.

As it is desirable to obtain a crystalline fructose resembling sucrose, it is necessary to obtain fructose in a particle size distribution and color similar to that of sucrose. If the slimy mass is introduced into the crystallization tank, the normal particle size growth which is desired is disrupted and the recovery of fructose which simulates sucrose in size will be substantially diminished.

The first component of the present invention is described as the aqueous dispersion (syrup). The aqueous dispersion contains the fructose which is to be crystallized. While the aqueous dispersion could consist essentially of fructose in water, it is more likely that other saccharides and various materials obtained in the processing of corn syrups will be present. Corn syrups are the preferred source of the fructose in the aqueous dispersion, however, any convenient source of fructose may be utilized. Dextrose will normally be present at from about 3% to 10% by weight in the syrup. If the dextrose is not separated out, it will be present with the crystalline fructose. Where desired, the dextrose may be further removed by selective crystallization or recrystallization of the fructose.

The amount of fructose in the aqueous dispersion as described in the Summary is preferably from about 88% to 97%, and most preferably from 93% to 96% by weight on a dry solids basis (d.s.b.).

The conditions for the aqueous dispersion prior to the addition of the alcohol are that the pH is desirably from about 3 to about 5, preferably from about 3.5 to about 4.8. The temperature of the aqueous dispersion at the time the alcohol is introduced is from about 50° C. to about 80° C., preferably from about 55° C. to about 70° C., most preferably from about 60° C. to 68° C. The temperature of the aqueous dispersion at this point is important in that the fructose must be maintained in a fluid state to allow processing.

The alcohols employed in the present invention are utilized to effectively remove (disassociate) water from the fructose. It has been found that the alcohols have a higher degree of affinity for the water than does the fructose. The addition of the alcohol thereby reduces the ability of the fructose to stay in the solution. While the fructose could precipitate out of the solution, such is avoided by maintaining the high temperature conditions and by mixing to keep the mixture homogeneous. A further benefit is that the resultant syrup has a lower viscosity after the alcohol addition.

The alcohols which are useful in the present invention include methanol, ethanol, isopropanol and mixtures thereof. The preferred alcohol is ethanol, both because it is a food-grade alcohol and because of its high affinity for water within the aqueous dispersion. A second preferred alcohol system is a combination of isopropanol and ethanol. Conveniently, such a mixture has a weight ratio of ethanol to the isopropanol of from 80:20 to about 98:2; preferably from about 85:15 to about 97:3; and most preferably from about 90:10 to about 96:4. When a mixture of alcohols is utilized, they may be added to the syrup either separately, or through premixing of the alcohols.

As ethanol is a regulated material, it may be denatured with any suitable material which does not adversely affect the aforedescribed process. Methanol may be conveniently used to denature the ethanol at from 1 to 10% by weight, particularly at 5% such as in 3A alcohol.

The temperature of the alcohol at the time it is added to the aqueous dispersion is critical to the present invention. The temperature of the aqueous dispersion has been previously defined. The temperature of the alcohol at the time of its introduction to the aqueous dispersion should be between about 46° C. and about 75° C.; preferably from about 55° C. to about 70° C.; and most preferably from about 62° C. to about 67° C. While minute quantities of alcohol could be added above or below the suggested temperatures, it must be remembered that this invention is a practical method for obtaining crystalline fructose. Therefore, the alcohol must be added to the aqueous dispersion at a rate which does not require holding the fructose at supersaturated conditions for substantial periods of time. That is, it is desirable to complete the addition of the alcohol within from about 15 seconds to about 20 minutes.

The use of hot alcohol to obtain the benefits of the invention is unexpected as one would commonly believe that cold alcohol should be employed as the subsequent crystallization step is an exothermic process. Therefore, adding heat energy to the system through the alcohol would not be expected to be part of an effective method of crystallizing fructose. In fact, the hot alcohol allows more rapid crystallization by avoiding the slime formation which is not conducive to crystalline fructose formation.

The weight ratio of the fructose in the aqueous dispersion to the alcohol is from about 3:1 to about 1:3; preferably from about 2:1 to about 1:2. The amount of alcohol required is also important in that unless the fructose is substantially dehydrated in the aqueous dispersion the crystallization will not proceed effectively.

The preferred order of addition is to add the alcohol to the aqueous dispersion. The reverse order of addition is more difficult but may be accomplished. If desired, the alcohol and the aqueous dispersion may be combined through the use of concentric heat exchanger tubing. This latter method allows the heated syrup to heat the alcohol, lessening the need for external heating of the alcohol. Therefore, a partially dehydrated aqueous dispersing coming off an evaporator at 85° C. to 95° C. can be used to transfer thermal energy to the alcohol. This procedure also lowers the temperature of the aqueous dispersion thereby allowing the mixing of the dispersion and the alcohol at substantially similar temperatures.

A further feature of the present invention is that during and after the addition of the alcohol the resulting aqueous dispersion is agitated in as near as possible to ideal mixing conditions. Any particular method of providing agitation may be utilized.

It is further desirable that the mixing should also be continued during the crystallization step which is preferably induced by utilizing a suitable food-grade seeding material. The preferred seeding material is crystalline fructose. Any other suitable sugar or saccharide may also be employed, however, as the goal is to obtain a high fructose yield with a high degree of purity, it is desirable to use pure fructose for the seeding. The crystallization of the fructose is desirably carried out with the homogeneous mixture between 30° C. and 50° C., preferably from 35° C. to 45° C. Once the process has been implemented in the plant, it is possible to utilize some of the product initially obtained as the crystallizing seed for later runs.

A further benefit of the present invention is that the use of the alcohol to remove water from the fructose also allows for the processing of the fructose at relatively low viscosities. That is, when the moisture is removed from the fructose, the resultant mixture becomes extremely viscous and difficult to process. The temperatures employed at this step are sufficient to maintain the alcohol laden syrup in a pumpable form as the alcohol reduces the viscosity substantially. If the alcohol were not present it would not be practical to cool and mix the syrup as is required for effective crystallization because of the high viscosity.

The processes described herein may be practiced either as a continuous or a batch method. Conveniently, the present process is a continuous method whereby the homogeneous mixture (alcohol added) is continually drawn off to a vessel wherein seeding occurs and the crystals of fructose of the desirable size are removed.

The crystalline fructose particles which can be obtained from the present invention average between 100 and 1000 microns; preferably from 150 to 500 microns which are approximately the size of sucrose crystals.

The product obtained herein is of high purity and is generally suitable for all applications in which crystalline fructose or sucrose is desired.

The following are suggested exemplifications of the present invention.

EXAMPLE I

A corn syrup is obtained by conventional processing. This corn syrup containing dextrose is then enzymatically isomerized (see Leiser U.S. Pat. No. 4,310,628 issued Jan. 12, 1982) to give an aqueous dispersion containing approximately 42 parts fructose, 54 parts dextrose, 4 parts higher saccharides with a total dry solids content of 71%. This aqueous dispersion (syrup) is then treated by the process described in U.S. Pat. No. 4,182,633 issued to Ishikawa et al on Jan. 8, 1980 to give two syrup fractions, one of which is 95% by weight fructose with the substantial remainder being dextrose and a small amount of higher saccharides. The fructose-rich syrup which contains 22% by weight solid material is then dehydrated by means of a vacuum evaporator to 92% dry solids.

The dehydrated fructose-rich syrup is maintained at 65° C. One hundred parts of this warm syrup is placed in a vessel and stirred by conventional means to give a stirring action as near to ideal as possible.

Forty-three parts of 3A alcohol (95:5 ethanol to methanol by weight) at 65° C. is then immediately added to the vessel as fast as possible. A visual observation of the vessel shows that the alcohol and syrup form a clear mixture which is a homogeneous solution. This homogeneous mixture is then drawn off to a second vessel for seeding with a small amount of crystalline fructose. The particles of fructose which are eventually obtained in a dry state resemble sucrose and have a particle dimension within that described in the Detailed Description of the Invention.

A comparative example is run under identical conditions with the only difference being that the alcohol is at 22° C. at the time of addition. In this case, the contents of the vessel are a milky white material indicating the presence of precipitated sugars. In attempting to transfer this mixture to a crystallization vessel, substantial difficulty is encountered in that the precipitated sugars tend to plate out on the pump surfaces. While a clear solution may eventually be obtained, a considerable amount of time, heat energy and mechanical energy is required to be added to the system where room temperature alcohol is employed. If added to a crystallization vessel, the milky white syrup disrupts crystal growth and tends to precipitate out on the sides of the vessel.

EXAMPLE II

A comparative test utilizing syrup at various temperatures and 3A alcohol at various temperatures is conducted as in Example I. In each case, the alcohol is added as rapidly as is practical as previously described. The syrup and the alcohol are used in a 1:1 weight ratio.

Table 1 set out below describes the observations made of the vessel at the respective syrup and alcohol temperatures shown.

TABLE 1

| Syrup Temperature | Alcohol Temperature | Observations |
|---|---|---|
| 50° C. | 45° C. | A milky white precipitate immediately forms indicating the presence precipitated sugars. |
| 50° C. | 50° C. | A slight precipitate forms but is easily dispersed by mixing action. |
| 55° C. | 55° C. | No milky white precipitate is observed at any point during the |

TABLE 1-continued

| Syrup Temperature | Alcohol Temperature | Observations |
|---|---|---|
| | | addition of the alcohol to the syrup. |

The above test results demonstrate that the alcohol must be substantially similar in temperature to the syrup to avoid the formation of a milky white slime indicating the presence of precipitated sugars.

Similar results are observed when using 23A alcohol (10:1 ethanol-acetone volume ratio), absolute isopropanol, absolute ethanol and absolute methanol.

Substantially similar results will be observed for higher syrup and alcohol temperatures as described herein.

I claim:

1. A process for the preparation of a clear homogeneous fructose alcohol dispersion suitable for introduction into a crystallizer for fructose crystallization comprising:

providing an aqueous high fructose dispersion having a fructose content of at least about 85% by weight, dry solids basis, maintaining said dispersion at an elevated temperature between about 50° C. and 80° C., admixing with said dispersion an amount of hot alcohol sufficient to form a fructose to alcohol weight ratio of 3:1 to 1:3, said alcohol being selected from ethanol, methanol, isopropanol and mixtures thereof, maintaining the temperature of said hot alcohol between about 46° C. and about 75° C., and controlling the temperature of said hot alcohol within said temperature range so that upon addition to said syrup formation of a precipitate is avoided.

2. The process of claim 1 wherein the aqueous dispersion contains from about 5% to about 15% by weight water.

3. The process of claim 1 wherein the fructose is present in the aqueous dispersion at from about 88% to about 97% by weight (d.s.b.).

4. The process of claim 1 wherein the alcohol is maintained between about 55° C. and about 70° C.

5. The process of claim 1 wherein the aqueous dispersion also contains dextrose.

6. The process of claim 1 additionally recovering fructose through seeding the homogeneous mixture to initiate crystallization.

7. The process of claim 6 wherein the seeding is accomplished using a saccharide.

8. The process of claim 7 wherein the seeding is accomplished utilizing crystalline fructose.

9. The process of claim 6 wherein the temperature of the homogeneous mixture is maintained between about 30° C. and about 50° C. during the crystallization.

10. The process of claim 6 wherein the recovered particles of crystalline fructose are substantially between about 100 and 1000 microns.

11. The process of claim 1 wherein a mixture of ethanol and isopropanol is employed.

12. The process of claim 11 wherein the ethanol and isopropanol is used in a respective weight ratio of from 80:20 to 98:2.

13. The process of claim 12 wherein the temperature of said hot alcohol is controlled so as to be substantially similar to the temperature of said dispersion.

14. The process of claim 11 wherein the temperature of said hot alcohol is controlled so as to be substantially similar to the temperature of said dispersion.

15. The process of claim 1 wherein the alcohol is ethanol.

16. The process of claim 1 wherein agitation is employed to maintain the homogeneous mixture.

17. The process of claim 1 wherein the pH of the aqueous dispersion is between about 3.0 and about 5.0 during addition of the alcohol.

18. The process of claim 1 wherein the alcohol is a mixture of methanol and ethanol.

19. The process of claim 18 wherein the temperature of said hot alcohol is controlled so as to be substantially similar to the temperature of said dispersion.

20. The process of claim 1 wherein the temperature of said hot alcohol is controlled so as to be substantially similar to the temperature of said dispersion.

* * * * *